US009339090B1

(12) United States Patent
Renegar

(10) Patent No.: US 9,339,090 B1
(45) Date of Patent: May 17, 2016

(54) MAGNETIC BADGE ATTACHMENT DEVICE

(71) Applicant: Ernest Renegar, Sanford, NC (US)

(72) Inventor: Ernest Renegar, Sanford, NC (US)

( * ) Notice: Subject to any disclaimer, the term of this patent is extended or adjusted under 35 U.S.C. 154(b) by 0 days.

(21) Appl. No.: 14/528,097

(22) Filed: Oct. 30, 2014

(51) Int. Cl.
*A44B 99/00* (2010.01)
*A44C 3/00* (2006.01)
*G09F 7/00* (2006.01)

(52) U.S. Cl.
CPC ..... *A44C 3/001* (2013.01); *A44B 99/00* (2013.01); *G09F 7/00* (2013.01)

(58) Field of Classification Search
CPC ..... G09F 7/00; A44C 3/001; A44B 99/00
USPC ..... 24/303
See application file for complete search history.

(56) References Cited

U.S. PATENT DOCUMENTS 2,707,344 A * 5/1955 Bolognese ..... A41D 29/00 40/1.5
2,795,876 A * 6/1957 Hayes ..... A44C 3/002 40/1.5
2,834,129 A * 5/1958 Kirkbride ..... A44C 3/002 40/1.5
3,942,273 A 3/1976 Adams
4,236,331 A * 12/1980 Mattson ..... G09F 7/00 40/1.5
D311,708 S 10/1990 Rankin
5,347,733 A * 9/1994 Whittington ..... G09F 7/04 24/303
5,682,648 A * 11/1997 Miller ..... A45F 5/08 24/303
5,682,653 A * 11/1997 Berglof ..... G09F 1/10 224/183
6,035,449 A * 3/2000 Galler ..... A41D 27/08 2/247
6,282,760 B1 * 9/2001 Mars ..... A44B 9/16 24/303
6,907,683 B1 6/2005 Kronblad
7,096,614 B1 8/2006 Williams
7,181,879 B1 2/2007 Key
8,333,025 B2 12/2012 Peterson et al.
8,356,433 B2 1/2013 Babbitt et al.
2007/0186390 A1 8/2007 Johnston
2011/0047838 A1 * 3/2011 Peterson ..... G09F 3/207 40/1.5
2011/0056100 A1 * 3/2011 Peterson ..... A44C 3/001 40/1.6

* cited by examiner

*Primary Examiner* — Robert J Sandy
*Assistant Examiner* — David Upchurch

(57) ABSTRACT

A magnetic badge attachment device removably attaches badges to clothing. The device includes a cover having a back face, a front face, and an open end. The front face of the cover is transparent. A cover magnet is coupled to the back face of the cover. A backing magnet is engageable to the cover magnet wherein the backing magnet is configured for securing a garment between the cover magnet and the backing magnet such that the front face of the cover is attached to and visible on the garment.

7 Claims, 4 Drawing Sheets

MAGNETIC BADGE ATTACHMENT DEVICE

BACKGROUND OF THE DISCLOSURE

Field of the Disclosure

The disclosure relates to attachment devices and more particularly pertains to a new attachment device for removably attaching badges to clothing.

SUMMARY OF THE DISCLOSURE

An embodiment of the disclosure meets the needs presented above by generally comprising a cover having a back face, a front face, and an open end. The front face of the cover is transparent. A cover magnet is coupled to the back face of the cover. A backing magnet is engageable to the cover magnet wherein the backing magnet is configured for securing a garment between the cover magnet and the backing magnet such that the front face of the cover is attached to and visible on the garment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
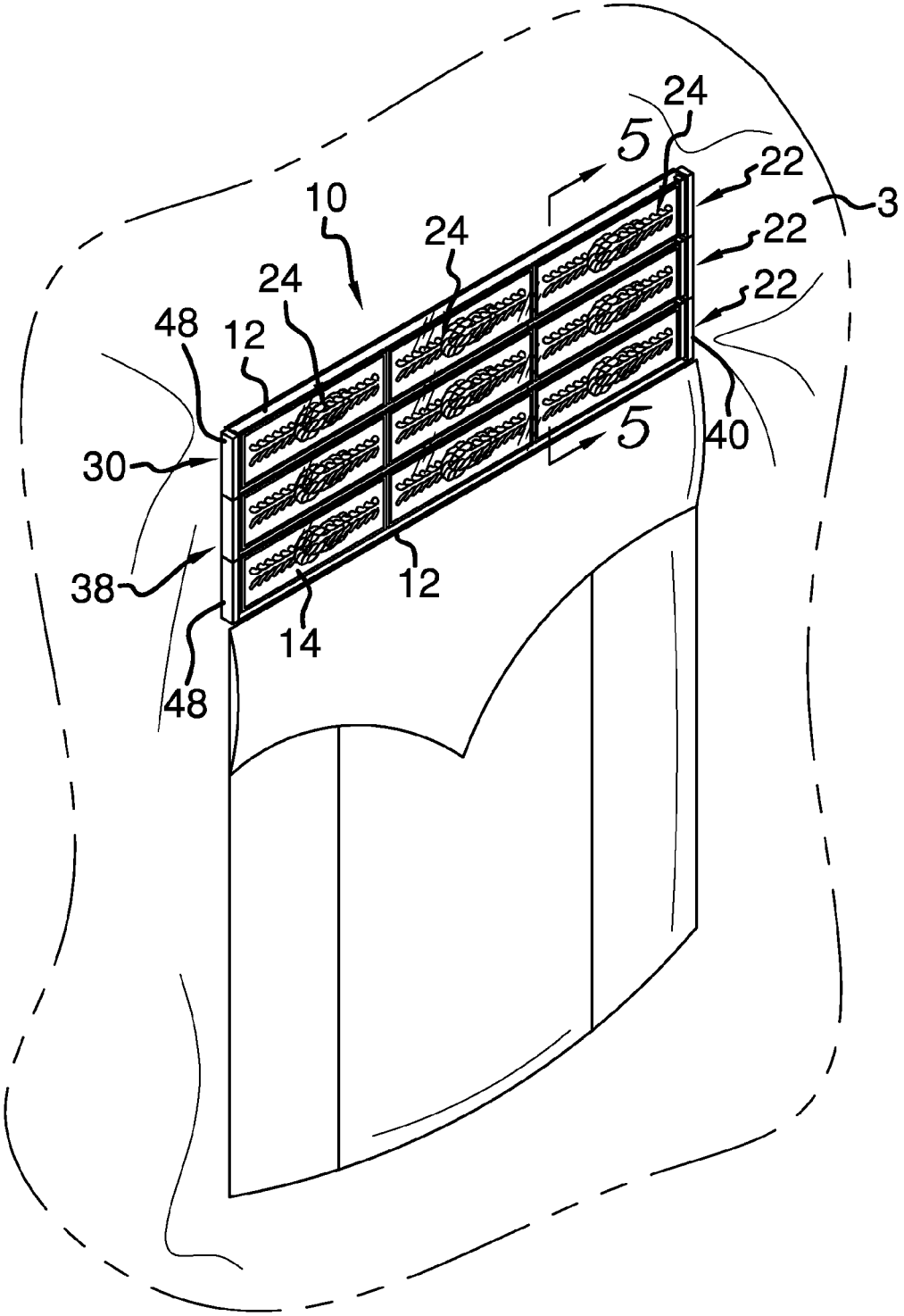
FIG. 1 is a top front side perspective view of a magnetic badge attachment device according to an embodiment of the disclosure.
Figure 2:
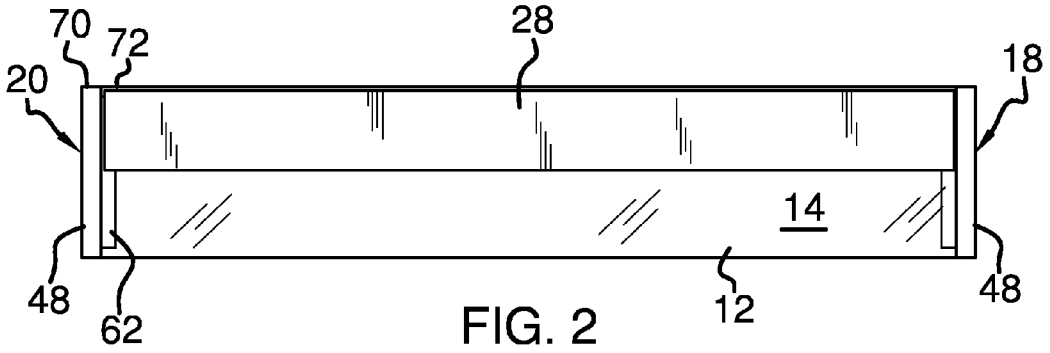
FIG. 2 is a back view of an embodiment of the disclosure.

With reference now to the drawings, and in particular to FIGS. 1 through 5 thereof, a new attachment device embodying the principles and concepts of an embodiment of the disclosure and generally designated by the reference numeral 10 will be described.

As best illustrated in FIGS. 1 through 5, the magnetic badge attachment device 10 generally comprises a plurality of covers 12. Each cover 12 has a respective back face 14, a front face 16, an open first end 18, and an open second end 20. The front face 16 of each cover 12 is transparent. Each cover may be constructed of plastic or the like. The covers 12 are coupled together and arranged into a plurality of rows 22. Each cover 12 is rectangular and elongated extending away from the first open end 18 to the second open end 20 wherein each cover 12 is configured for holding multiple elongated rectangular badges 24. An interior space 26 of each cover 12 may be complementary to multiple aligned badges 24 such that the badges 24 are neatly displayed within the cover 12.

An upper cover magnet 28 is coupled to the back face 14 of an uppermost one 30 of the covers 12. An upper backing magnet 32 is engageable to the upper cover magnet 28 wherein the upper backing magnet 32 is configured for securing a garment 34 between the upper cover magnet 28 and the upper backing magnet 32. Thus, the front face 16 of each cover 12 is attached to and visible on the garment 34. The upper cover magnet 28 and upper backing magnet 32 may be of sufficient attraction to securely hold the garment 34 preventing shifting of the covers 12 relative to the garment 34. A lower cover magnet 36 is coupled to the back face 14 of a lowermost one 38 of the covers 12. A lower backing magnet 40 is engageable to the lower cover magnet 36 wherein the lower backing magnet 40 is configured for securing the garment 34 between the lower cover magnet 36 and the lower backing magnet 40.

Adhesive tape 42 is coupled to and extends between respective back faces 14 of adjacently positioned covers 12 wherein the adjacently positioned covers 12 are coupled together. The adhesive tape may be positioned to hold the adjacently positioned covers 12 in abutment.

Each of a plurality of end caps 48 is engageable to an associated one of the covers 12 such that the end cap 48 closes an associated one of the first open end 18 and the second open end 20 of the associated cover 12. Thus, each end cap 48 is configured for selectively providing access to the interior space 26 and securing a respective badge 24 inside of the associated cover 12. Each end cap 48 may comprise a rectangular protrusion 62 complementary to and insertable into the associated cover 12 to frictionally engage the cover 12. An outer perimeter edge 70 of each end cap 48 may be flush with an outer peripheral edge 72 of the associated cover 12.

Figure 3:
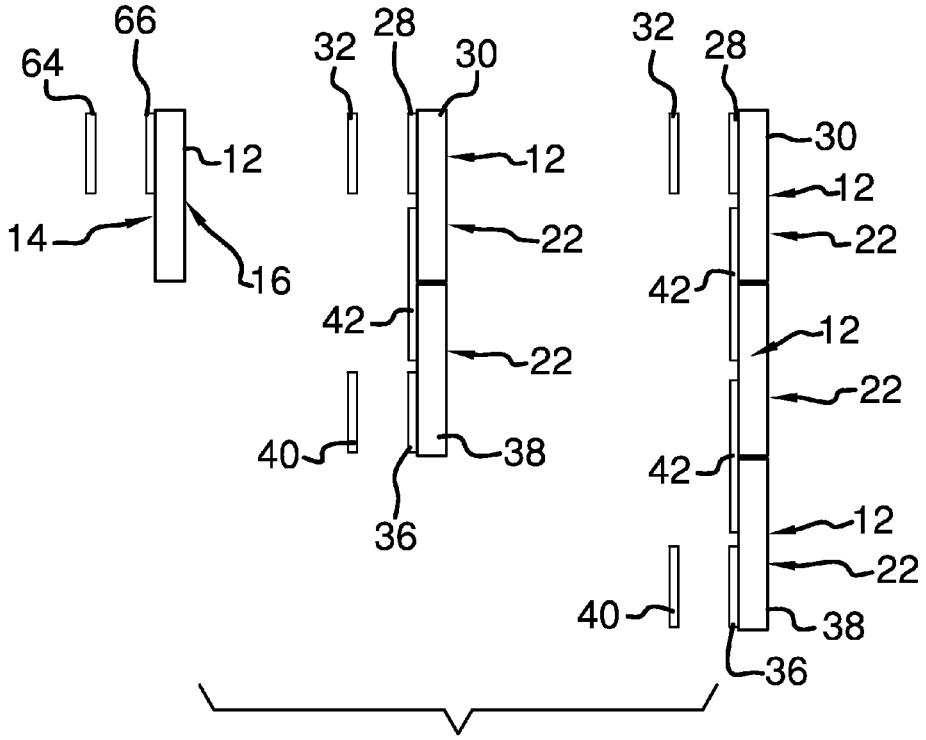
FIG. 3 is a side view of multiple configurations an embodiment of the disclosure.
Figure 4:
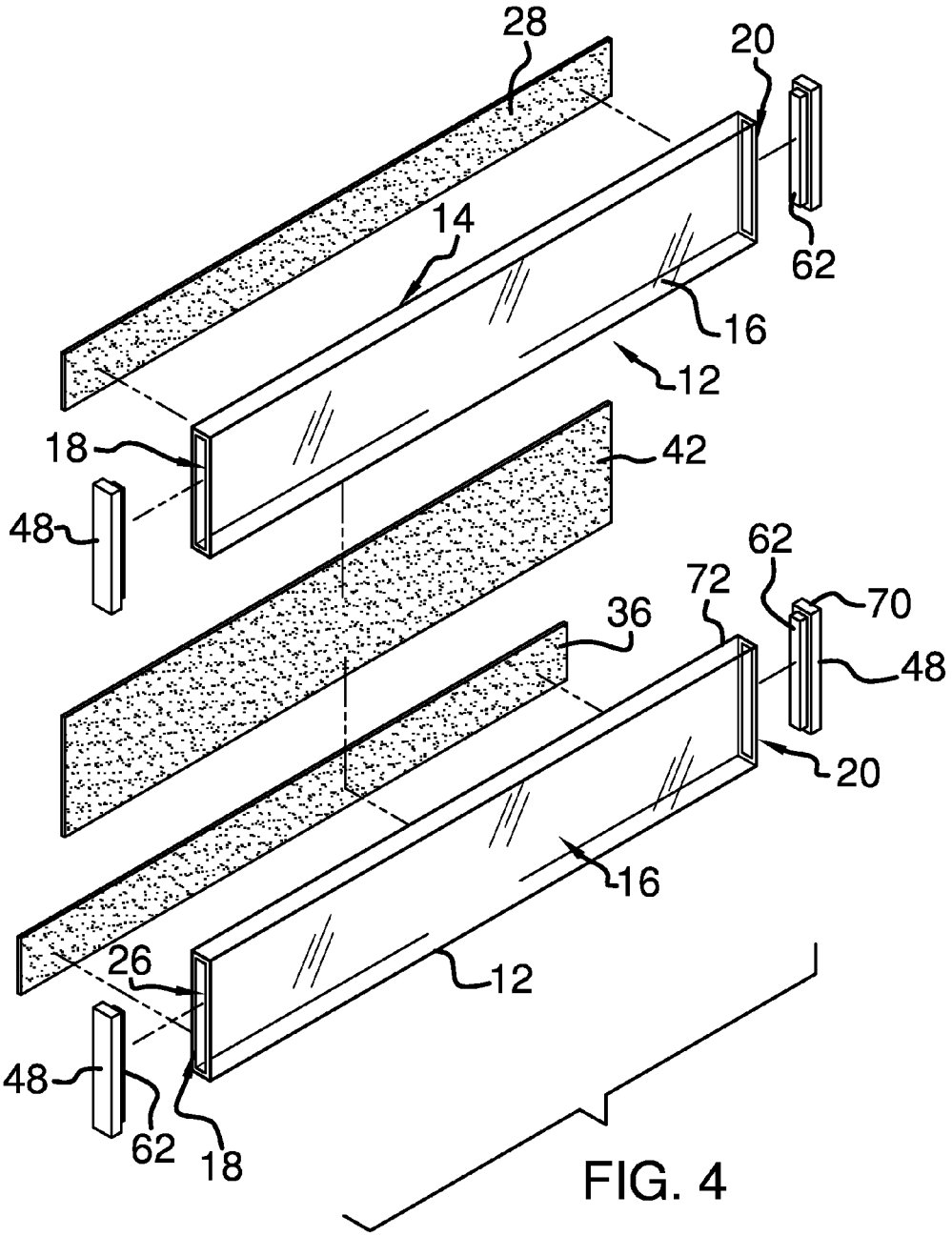
FIG. 4 is an exploded top front side view of an embodiment of the disclosure.
Figure 5:
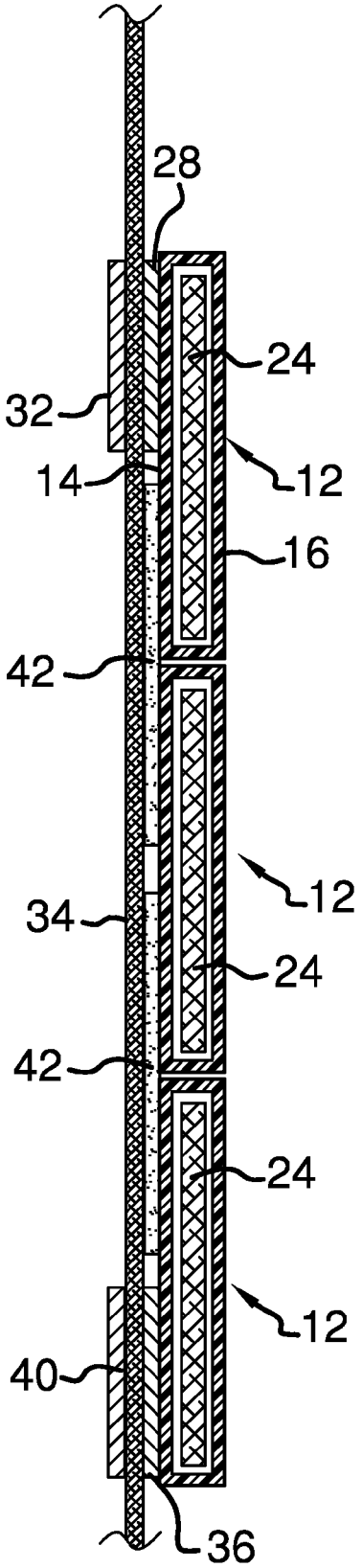
FIG. 5 is a cross-sectional view of an embodiment of the disclosure taken along line 5-5 of FIG. 1.

The device 10 may also comprise a single cover 12 as described above utilizing a single cover magnet 66 and a single backing magnet 64 as shown in one of the configurations of FIG. 3.

In use, badges 24 are inserted into the appropriate configuration of covers 12 to hold the badges 24. The badges 24 are held in the cover 12 or covers 12 by end caps 28. The cover 12 or covers 12 are secured to the garment 34 in a desired position as described above.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A magnetic badge attachment device comprising:

a plurality of covers, each said cover having a back face, a front face, and an open end, said front face of each said cover being transparent, said covers being coupled together and arranged into a plurality of rows;

an upper cover magnet coupled to said back face of an uppermost one of said covers;

an upper backing magnet engageable to said upper cover magnet wherein said upper backing magnet is configured for securing a garment between said upper cover magnet and said upper backing magnet such that said front face of each said cover is attached to and visible on the garment.

2. The device of claim 1, further comprising:

a lower cover magnet coupled to said back face of a lowermost one of said covers; and a lower backing magnet engageable to said lower cover magnet wherein said lower backing magnet is configured for securing the garment between said lower cover magnet and said lower backing magnet.

3. The device of claim 2, further comprising adhesive tape, said adhesive tape being coupled to and extending between respective back faces of adjacently positioned said covers wherein said adjacently positioned covers are coupled together.

4. The device of claim 1, further comprising a plurality of end caps, each said end cap being engageable to an associated one of said covers such that said end cap closes said open end of said associated cover wherein each said end cap is configured for securing a respective badge inside of said associated cover.

5. The device of claim 1, further comprising each said cover being rectangular and elongated extending away from said open end of said cover wherein each said cover is configured for holding multiple elongated rectangular badges.

6. The device of claim 1, further comprising:

said open end of each said cover being a first open end, each said cover having a respective second open end opposite said first open end of said cover; and a plurality of end caps, each said end cap being engageable to an associated one of said covers such that said end cap closes an associated one of said first open end and said second open end of said associated cover wherein each said end cap is configured for securing a respective badge inside of said associated cover.

7. A magnetic badge attachment device comprising:

a plurality of covers, each said cover having a back face, a front face, an open first end, and an open second end, said front face of each said cover being transparent, said covers being coupled together and arranged into a plurality of rows, each said cover being rectangular and elongated extending away from said open end of said cover wherein each said cover is configured for holding multiple elongated rectangular badges;

an upper cover magnet coupled to said back face of an uppermost one of said covers;

an upper backing magnet engageable to said upper cover magnet wherein said upper backing magnet is configured for securing a garment between said upper cover magnet and said upper backing magnet such that said front face of each said cover is attached to and visible on the garment;

a lower cover magnet coupled to said back face of a lowermost one of said covers;

a lower backing magnet engageable to said lower cover magnet wherein said lower backing magnet is configured for securing the garment between said lower cover magnet and said lower backing magnet;

adhesive tape, said adhesive tape being coupled to and extending between respective back faces of adjacently positioned said covers wherein said adjacently positioned covers are coupled together; and a plurality of end caps, each said end cap being engageable to an associated one of said covers such that said end cap closes an associated one of said first open end and said second open end of said associated cover wherein each said end cap is configured for securing a respective badge inside of said associated cover.

* * * * *